United States Patent [19]

Pieper et al.

[11] Patent Number: 4,804,511

[45] Date of Patent: Feb. 14, 1989

[54] PROCESS FOR DRY SPINNING YARNS OF IMPROVED UNIFORMITY AND REDUCED ADHESION

[75] Inventors: Christian Pieper; Hans K. Burghartz, both of Neuss; Rolf-Burkhard Hirsch, Dormagen; Norbert Rink, Röthenbach/St. Wolfgang, all of Fed. Rep. of Germany

[73] Assignee: Bayer Aktiengesellschaft, Leverkusen, Fed. Rep. of Germany

[21] Appl. No.: 129,325

[22] Filed: Dec. 2, 1987

Related U.S. Application Data

[63] Continuation of Ser. No. 744,345, Jun. 13, 1985, abandoned.

[30] Foreign Application Priority Data

Jul. 3, 1984 [DE] Fed. Rep. of Germany ..... 3424343

[51] Int. Cl.[4] ..... D01D 5/04

[52] U.S. Cl. ..... 264/206; 264/205; 264/211.14; 264/211.17; 425/72.2

[58] Field of Search ..... 264/205, 206, 204, 211.14, 264/211.17, 182; 425/72.2, 464

[56] References Cited

U.S. PATENT DOCUMENTS

| | | | |
|---|---|---|---|
| 2,615,198 | 10/1952 | Flannagan | 264/206 |
| 3,111,368 | 11/1963 | Romano | 264/205 |
| 3,135,811 | 6/1964 | Barnett et al. | 264/211.14 |
| 3,458,616 | 7/1969 | Guess, Jr. et al. | 264/206 |
| 3,650,716 | 3/1972 | Brossard | 425/464 |
| 3,705,227 | 12/1972 | Fintel et al. . | |
| 3,737,508 | 6/1973 | Weir | 264/204 |
| 3,959,057 | 5/1976 | Smith | 264/167 |
| 3,969,462 | 7/1976 | Stofan | 264/211.15 |
| 4,123,208 | 10/1978 | Klaver . | |
| 4,259,048 | 3/1981 | Miani . | |
| 4,378,325 | 3/1983 | Waite | 264/211.14 |
| 4,402,900 | 9/1983 | Berry, Jr. | 264/204 |

*Primary Examiner*—Jan H. Silbaugh
*Assistant Examiner*—Hubert C. Lorin
*Attorney, Agent, or Firm*—Sprung Horn Kramer & Woods

[57] ABSTRACT

Extraordinarily low ranges of error, with respect to yarn adhesion and uniformity, in dry spinning yarns are achieved when the spinning gas in the upper part of the shaft blasts the yarns radially from the inside to the outside in an apparatus designed for this purpose, the velocity of the radial flow of gas, dirctly below the spinning nozzle, transverse to the running direction of the yarns and within a spacing of 10 mm from the nozzle, increasing from 0 to at least from 0.2 to 1 m/s.

6 Claims, 4 Drawing Sheets

PROCESS FOR DRY SPINNING YARNS OF IMPROVED UNIFORMITY AND REDUCED ADHESION

This application is a continuation of application Ser. No. 744,345, filed June 13, 1985, now abandoned.

BACKGROUND OF THE INVENTION

This invention relates to a process and an apparatus for dry spinning synthetic polymers, in which the yarns are blasted with hot gas be means of a blasting apparatus, radially from the inside to the outside below an annular spinning nozzle.

When dry spinning polymers, such as acrylonitrile polymers, polyurethane and aromatic polyamides, the hot spinning solution is normally forced through the bores of the spinning nozzle in a spinning shaft charged with hot gas. The solvent is thereby evaporated from the yarns.

It is important that the solvent is evaporated as quickly as possible, so that the yarns do not adhere due to too high a solvent content, when they beat against each other, this taking place particularly when the spacings between the holes on the nozzle are very small and the circulation of air in the shaft is unstable.

The hot spinning gas is at present normally blasted or blown in at the upper end of the spinning position above the spinning nozzle via screens and air filters and flows through the heated shaft in the direction in which the yarn is drawn off, the solvent being evaporated from the yarns and the gas being cooled. The gas enriched with solvent is drawn off by suction at the lower end of the shaft.

In this parallel flow of the hot spinning gas, the yarns which are removed further from the flow of gas, are not dried fast enough and show high fault rates owing to adhesion, as well as thick and thin regions.

A contrastingly improved apparatus for dry spinning is described in U.S. Pat. No. 3,737,508, in which some of the spinning gas, which is fed in parallel to the running direction of the yarns outside an annular nozzle, is drawn off by suction through the inside of the annular nozzle by means of gas supply devices, so that this partial flow flows transversely from the outside to the inside through the yarns below the nozzle. The remainder of the spinning gas flows with the yarns through a heated spinning shaft and is drawn off by suction at the end thereof. This apparatus suffers from the disadvantage that the inner row of yarns are not dried sufficiently quickly and still has a large number of points of adhesion.

In DE-OS No. 1,760,377, this disadvantage is partially compensated for in that the inner solution yarns issue from the spinning nozzle at a relatively high temperature. The technical cost of this solution is, however, exceedingly high.

Moreover, the transverse flow from the outside to the inside suffers from the disadvantage that the gas velocity from the outside to the inside increases since the space existing for the flow of gas towards the inside becomes smaller and the solvent-containing yarns act as gas sources. This produces a more substantial mechanical stressing and deflection of the yarns, which are positioned closest to the inner suction region, adhesion and splitting again being produced at weak spots.

SUMMARY OF THE INVENTION

It has now surprisingly been found that with an apparatus, in which the yarns are blasted or blown transversely from the inside to the outside, extraordinarily low error rates are achieved during dry spinning.

Thus an object of the invention is a process for dry spinning, in which a polymer solution is forced through the bores of an annular spinning nozzle in a spinning shaft which is charged with hot gas and the solvent is then evaporated from the yarns, the temperature of the shaft wall and of the spinning gas being higher than those of the spinning solution, characterized in that the spinning gas in the upper part of the shaft blasts the yarns radially from the inside to the outside, the velocity of the radial flow of gas directly below the spinning nozzle transverse to the running direction of the yarns and within a spacing of 10 mm from the nozzle, increasing from 0 to at least from 0.2 to 1 m/s.

The radial flow of gas preferably maintains its velocity transverse to the running direction of the yarns at a measured distance of from 50 to 200 mm from the nozzle.

The gas flow is deflected in the further course of the spinning shaft in a gas flow parallel to the running direction of the yarns, by the fast running yarns and the shaft wall. The spinning gas is drawn off by suction as usual at the shaft end.

A further object of the invention is an apparatus for carrying out the process according to the invention, containing a spinning shaft with an annular spinning nozzle applied at the head and a spinning gas conduit, characterized in that the spinning gas conduit is cylindrical and is applied concentrically to the annular spinning nozzle in the inside of the annular spinning nozzle, and continues below the nozzle in a 50 to 200 mm, preferably 80 to 110 mm likewise cylindrical gas distributor projecting into the spinning shaft, the cylindrical generated surface of which is gas permeable.

The base of the gas distributor is preferably gas impermeable. The length is preferably from 80 to 110 mm, the diameter of the gas distributor is from 60 to 120 mm, particularly from 80 to 90 mm in the case of the spinning shaft characterized below.

DETAILED DESCRIPTION OF THE INVENTION

Figure 1:
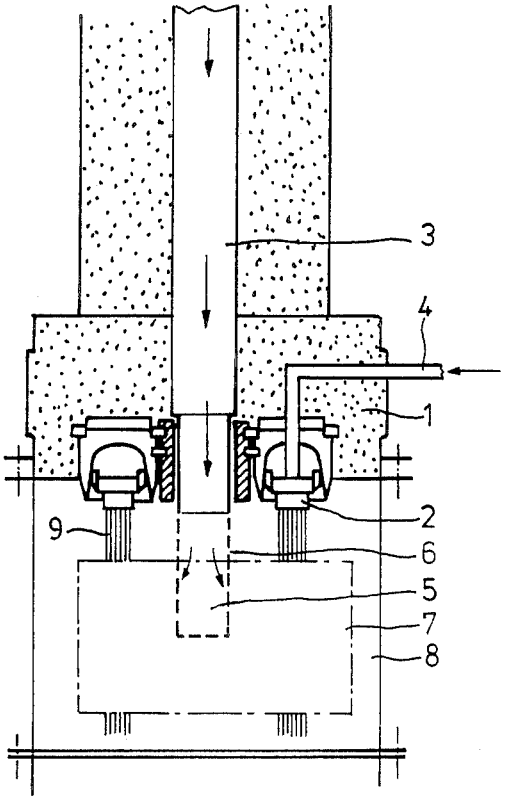
FIG. 1 shows a longitudinal section through the apparatus according to the invention.

In FIG. 1, (1) represents the spinning head, in which there is an annular spinning nozzle (2) with a spinning gas conduit (3) positioned on the inside and a connected spinning solution conduit (4). The spinning gas distributor (5) is provided with woven braid fabric (6), so that (in this case) the spinning gas can flow radially to the outside and to the bottom. Not only the spinning yarns (9) can be observed through the spinning shaft window (7) of the spinning shaft (8), but the spinning gas distributor (5) can also be easily exchanged.

The spinning solution is pumped into the annular spinning nozzle and extruded through the nozzle bores into the heated spinning shaft. The spinning solution, preferably a solution of an acrylonitrile polymer in dimethyl formamide, has a dynamic viscosity at 80° C. of from about 10 to 100 Pascal sec, preferably from 20 to 40, the nozzle outlet bores have a diameter of from 0.15 to 0.8 mm, preferably from 0.20 to 0.30, and a spacing between the holes of from about 2 to 10, mm, preferably from 2.5 to 3.5 mm. The solution yarns are drawn off at a velocity of from about 50 to 1,000 m/min, preferably from 200 to 300 m/min through the heated spinning shaft from about 2 to 10 m, preferably from 5 to 8 m, in length, the shaft having a diameter of from about 20 to 40 cm, preferably from 25 to 30 cm.

The hot spinning gas has a temperature which is at least 5° C. above the temperature of the spinning yarns, preferably from about 150° to 350° C. The air distributor is positioned at from about 0.5 cm to 5 cm from the innermost row of yarns.

The spinning gas distribution according to the invention is preferably achieved with a cylinder, the casing of which is provided with a woven braid material and is preferably gas impermeable on the base in the direction of the shaft. Woven wire material is suitable as woven braid material, which woven wire material has a wire density of from 10 to 40 wires per cm in the weaving direction, preferably 21 cm, and from about 6 to 18 wires per cm, preferably 10.5 cm perpendicular to the weaving direction, the wires having a diameter of from about 0.1 to 0.5 mm, preferably 0.3 mm. The air supply conduit is well insulated in order to prevent the loss of heat and for local heating on the spinning nozzle. The air distributor is applied such that during the spinning process, it can be easily incorporated and removed for cleaning individual nozzle orifices or for cleaning the distributor itself.

When using the process according to the invention, it has been shown that good spinning results are obtained when relatively low spinning gas quantities of from 0.8 to 230 $Nm^3$/kg of solution, preferably from 1 to 2 $Nm^3$/kg, in the case of a 29% by weight polyacrylonitrile solution in dimethyl formamide. The small spinning gas quantity supplied also gives rise to a small quantity of waste gas.

The spinning yarns which are at a spacing of from about 0.5 to 20 cm from the gas distributor, are easily arched towards the outside during the spinning process. It has been shown that the yarns taper during spinning on a section of from 1 to 5 cm below the nozzle on the almost terminal cross-section thereof. With the process according to the invention, adhesionfree yarns can be produced, preferably from acrylonitrile polymers, with an individual spinning titre of from 2 to 80 dtex. These yarns have a high degree of uniformity in cross-section and in their textile values and are substantially free from solvent.

EXAMPLE 1

Figure 2:
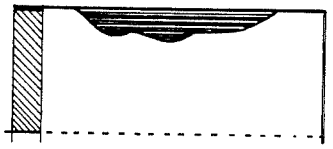
FIGS. 2 to 6 show different embodiments of the spinning gas conduit and the velocity profiles thereby achieved of the air flowing radially to the outside (more detailed explanations in Example 3).
Figure 6:
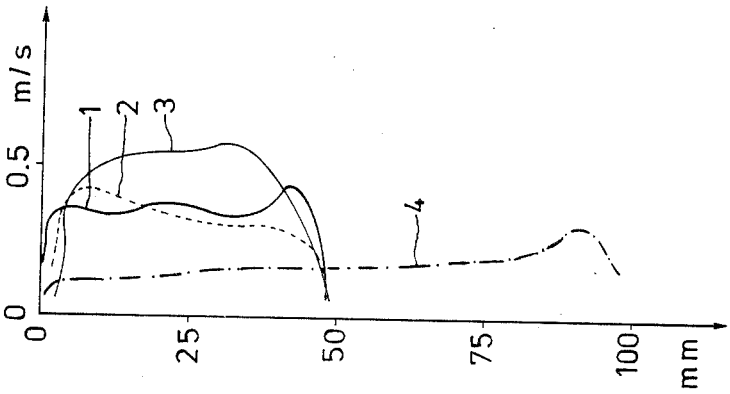
Figure 7:
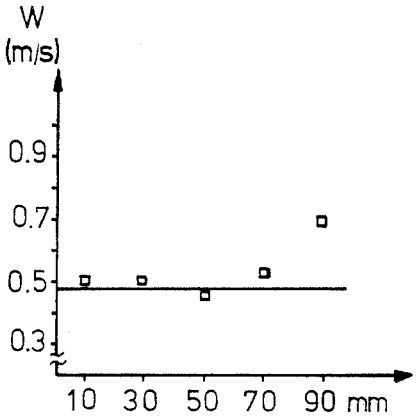
FIGS. 7 to 16 show velocity profiles produced with different spinning gas conduits (more detailed explanations in Example 4).
Figure 8:
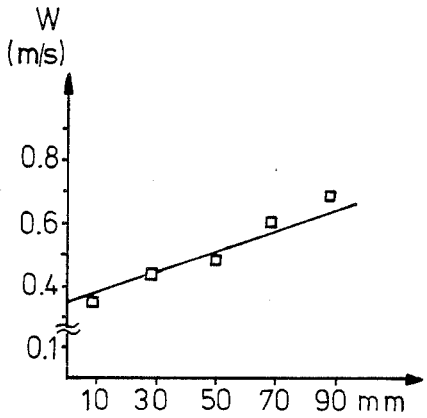
Figure 9:
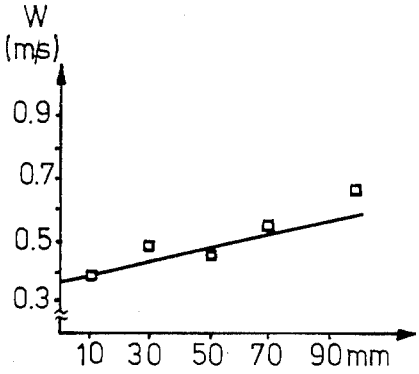
Figure 10:
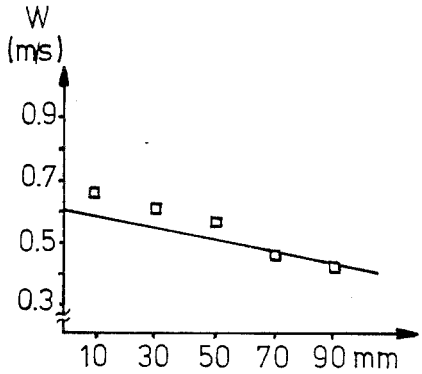
Figure 11:
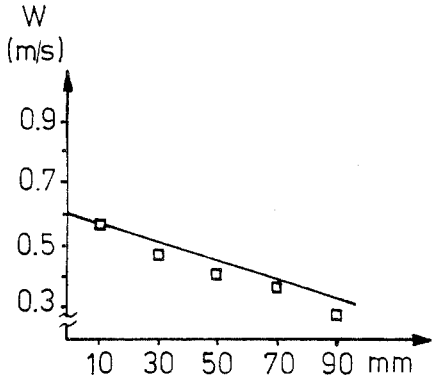
Figure 12:
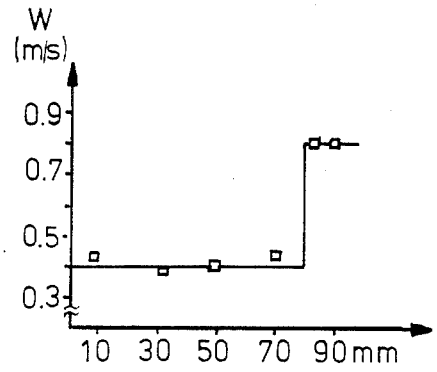
Figure 13:
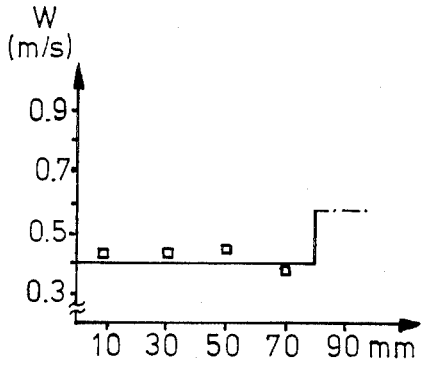
Figure 14:
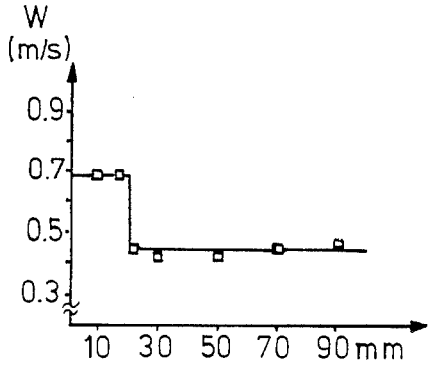
Figure 15:
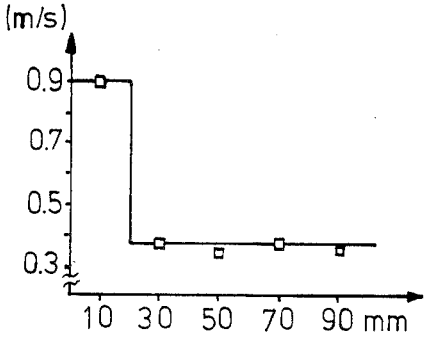
Figure 16:
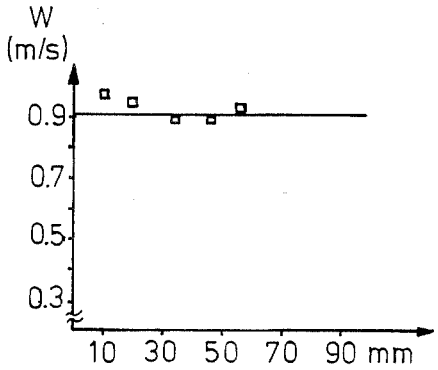

An acrylonitrile copolymer with a relative viscosity of $t_p$=1.89 $t_D$ of 93.6% by weight of acrylonitrile (ACN), 5.7% by weight of acrylic acid methyl ester (AME) and 0.7% by weight of sodium methyllyl sulphonate are dissolved at 80° C. in dimethyl formamide (DMF), so that a 29.5% by weight spinning solution (quantity) based on quantity of solution) is obtained. ($t_p$ and $t_D$ represent the times required for predetermined amounts of solution to pass through a capillary tube, such times constituting a measure for the molecular weight. Thus, the time $t_p$, which is required for an 0.5% polymer solution in DMF to pass through the capillary at 20° C. is compared with the time $t_D$ which is required for pure DMF to pass through the same capillary.) The solutions are heated to 130° C. in a preheater and passed into an annular spinning nozzle. The solution has a viscosity of about 10 Pascal sec. In the annular spinning nozzle, which is well insulated in relation to the spinning gas conduit and does not have its own cooling, the nozzle bores have a minimum spacing between the holes of 3.4 mm, the nozzle bores having a diameter of 0.25 mm. The spinning yarns are blasted transversely from the inside to the outside with 230° C. hot air, a hollow cylinder serving to distribute the air, which hollow cylinder has a diameter of 85 mm and a length of 95 mm. The base of the cylinder is sealed with a metal plate. The hot spinning air is blasted into the air distributor through a pipe, which is well insulated against the environment and is conveyed towards the outside through the perforated woven braid material of the cylinder casing in a radialsymmetric manner. The used woven braid material has a wire thickness of 21 wires per cm in the weaving direction and 10.5 wires per cm perpendicular to the weaving direction. The wires have a diameter of 0.3 mm. 1.43 $Nm^3$ of air per kg of interspersed solution are blasted into the air distributor. FIG. 6, no. 1 (corresponding to the supply of spinning gas according to FIG. 2) shows the velocity profile of the transverse flow on the surface of the woven braid material as a function of the spacing of the upper edge of the woven braid material which is at the same height as the annular nozzle. The solution yarns have a temperature of about 146° C. The yarns are drawn off at about 230 m/min through the 8 m long shaft heated to 180° C. and after a spacing of about 20 mm from the nozzle already have a diameter which diverges less than 20% from the terminal diameter of the yarns. The spinning bulk, which is obtained in this manner, has a DMF-content of 11% by weight, a titre of 10 dtex±0.5 dtex, a strength of 0.58 cN/dtex±0.1 cN/dtex (unstretched) and an elongation of 102%±12%. The spinning bulk has in the case of thirty measurements, less than 5 errors per 100,000 capillaries, the following being considered as errors: adhesion, thick and thin filaments. (The values behind the sign±give the standard deviation for the measuring results).

The specific energy consumption on the air side of 0.24 kWh/kg PAN is very low in the case of the apparatus according to the invention. Furthermore, owing to the low specific use of air, there are reduced difficulties in handling the outgoing effluent air which has been contaminated with solvent-containing vapours.

EXAMPLE 2

Further spinning adjustments are undertaken on the same apparatus. The parameters changed in relation to the first Example are brought together in Table 1.

TABLE 1

| | Example | | | | | | | |
|---|---|---|---|---|---|---|---|---|
| | 1 | 2 | 3 | 4 | 5 | 6 | 7 | 8 |
| Polymer | A | A | A | A | A | B | A | C |

TABLE 1-continued

| | Example | | | | | | | |
|---|---|---|---|---|---|---|---|---|
| | 1 | 2 | 3 | 4 | 5 | 6 | 7 | 8 |
| Solvent | DMF | DMF | DMF | DMF | DMF | DMF | DMF | DMF |
| Polymer content (%) | 29.5 | 29.5 | 29.5 | 30 | 29.5 | 24 | 29.5 | 22 |
| Relative viscosity | 1.89 | 1.89 | 1.89 | 1.89 | 1.89 | 2.13 | 1.87 | |
| Dissolving temperature (°C.) | 80 | 80 | 80 | 80 | 80 | 90 | 80 | 60 |
| Temperature according to preheater (°C.) | 130 | 130 | 130 | 130 | 130 | 130 | 135 | 50 |
| Solution viscosity (Pas) | 10 | 10 | 10 | 10.5 | 10 | 12 | 10 | 20 |
| Minimum spacing between holes (mm) | 2.4 | 2.4 | 3.0 | 3.5 | 3.5 | 2.4 | 3.5 | 10.5 |
| Nozzel bore (mm) | 0.25 | 0.25 | 0.25 | 0.3 | 0.25 | 0.25 | 0.3 | 0.3 |
| Spinning air temperature (°C.) | 300 | 290 | 350 | 350 | 300 | 300 | 155 | 200 |
| Specific air quantity ($Nm^3$/kg solution) | 1.43 | 1.63 | 1.15 | 1.38 | 1.43 | 1.3 | 8.5 | 26 |
| Shaft temperature (°C.) | 180 | 190 | 200 | 200 | 190 | 195 | 120 | 200 |
| Spinning drawing-off (m/min) | 230 | 315 | 252 | 200 | 820 | 100 | 600 | 300 |
| DMF content (%) | 11 | 10 | 22 | 23 | 24 | 37 | 16 | 1 |
| Titre (dtex) | 10 ± 0.5 | 5.9 ± 0.3 | 20 ± 1 | 35 ± 1.5 | 6.8 ± 0.5 | 18.9 | 2 | 8 |
| Strength (cN/dtex) | 0.58 ± 0.1 | 0.58 ± 0.1 | 0.64 ± 0.1 | 0.56 ± 0.1 | 0.55 ± 0.1 | 1.0 ± 0.2 | 0.68 | 0.9 |
| Elongation (%) | 102 ± 12 | 89 ± 8 | 125 ± 13 | 130 ± 14 | 50 ± 10 | 159 | 82 | 450 |
| Errors (per 100,000) | <10 | <8 | <10 | <5 | <10 | <5 | <5 | <5 |

A: Copolymer corresponding to Example 1
B: 100% of pure polyacrylonitrile
C: Segmented polyurea - polyurethane

EXAMPLE 3

The conditions of Example 1 are all adhered to. Only the velocity profile of the radial flow from the air distributors is changed by changing the air distributor. In FIG. 6, some blasting profiles of the radial flow from the air distributors are brought together. Profile 1 is thereby correlated with FIG. 2, profile 3 with FIG. 3, profile 3 with FIG. 4 and profile 4 with FIG. 5.

Figure 3:
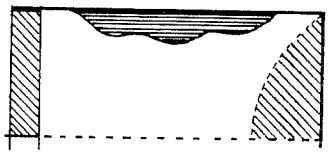
Figure 4:
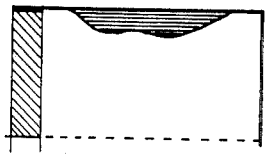
Figure 5:
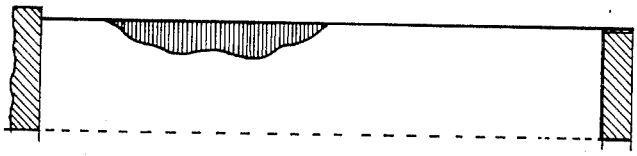

In this drawing, the schematic representation of some spinning gas conduits projecting into the shaft (halved longitudinal section, see also FIG. 1 detail (3)) can be seen. The cylindrical spinning gas conduit represented by 1 has a woven braid material as casing, which has a length of 95 mm and a diameter of 85 mm. A gas velocity profile of the transverse flow on the cylinder casing surface is achieved with this gas distributor, while profile is represented by the curve 1 where the axes meet. The gas velocity is measured in a cold state a room temperature with a hot wire anemometer. The spinning gas supply device according to FIG. 3 is transformed in relation to FIG. 2 in a manner such that a convex arched base is incorporated in the apparatus. A gas velocity profile of the transverse flow is thereby obtained, as represented by the curve 2. The gas supply devices according to FIGS. 4 and 5 are changed regarding length and diameter as well as regarding the weaving direction of the woven braid material, examined regarding the gas velocity profile and represented by the curves 3 and 4.

The rate of error on the spun yarns for the individual flow profiles are as follows:

| Profile No. | Rate of Error per 100,000 Capillaries |
|---|---|
| 1 | <5 |
| 2 | <10 |
| 3 | <30 |
| 4 | <30 |

The other quality-determining characteristics of the yarns correspond to those in experiment 1.

EXAMPLE 4

The conditions of Example 1 are all adhered to, only the velocity profile is not produced as in Example 1 by an air distributor with woven braid material, but with air distributors, which in place of the woven braid material have a cylinder casing with electron-beam-perforated sheets with a thickness of 1 mm. The holes have a diameter of 0.2 mm.

Different blasting profiles are produced above the division of holes (triangular position). FIGS. 7 to 16 show the gas velocity profiles of the transverse flow or the surface of the cylinder casing of the gas distributor. The results of the experiments are as follows:

| Profile of FIG. | Rate of Error/100,000 capillaries |
|---|---|
| 7 | <40 |
| 8 | <300 |
| 9 | <500 |
| 10 | <30 |
| 11 | <80 |
| 12 | <1000 |
| 13 | <300 |
| 14 | <80 |
| 15 | <150 |
| 16 | <150 |

The remaining quality-determining characteristics of the yarns have in the case of strength and elongation in relation to the yarns in Example 3 somewhat poorer values with relatively large dispersions.

We claim:

1. In a process for dry spinning yarns, in which a polymer solution containing a solvent is forced into a spinning shaft charged with hot spinning gas through bores of an annular spinning nozzle to produce spinning yarns and the solvent is then evaporated from the yarns, the temperature of the shaft wall and of the spinning gas being higher than that of the spinning solution, the improvement comprising introducing the spinning gas by a cylindrical gas distributor disposed concentrically within the annular spinning nozzle and extending 50 to 200 mm below the nozzle and having a gas permeable axial surface along the length thereof and a gas impermeable radial surface at the bottom thereof to blow the yarns with the spinning gas at a velocity and flowing only radially from the inside to the outside in an upper part of said shaft, said velocity of the radial flow of gas directly below the spinning nozzle and within a spacing of 10 mm from the nozzle, increasing from 0 to at least 0.2 to 1 m/s transverse to the running direction of the yarns to thereby produce yarns of improved uniformity and reduced adhesion.

2. The process according to claim 1, wherein the gas distributor is disposed at from about 0.5 cm to 20 cm from the yarns.

3. The process according to claim 1, wherein the gas distributor is disposed at from about 0.5 cm to 5 cm from the yarns.

4. The process according to claim 1, wherein the quantity of spinning gas is from 1.15 to 26 $Nm^3/kg$ and the solution is 22 to 30% by weight of a polymer

5. The process according to claim 4, wherein the polymer solution comprises polyacrylonitrile at 29% by weight in dimethyl formamide and the quantity of spinning gas is from 1 to 2 $Nm^3/kg$.

6. The process according to claim 1, wherein gas is blown only radially by providing a woven braid as the gas distributor cylinder walls.

* * * * *